US009174241B2

(12) United States Patent
Brunone

(10) Patent No.: US 9,174,241 B2
(45) Date of Patent: Nov. 3, 2015

(54) SCREEN COMPRISING A PLURALITY OF STACKED DECKS AND MEANS FOR VERTICALLY SEPARATING THE DECKS FROM ONE ANOTHER

(71) Applicant: René Brunone, Saint-Marcel (FR)

(72) Inventor: René Brunone, Saint-Marcel (FR)

( * ) Notice: Subject to any disclaimer, the term of this patent is extended or adjusted under 35 U.S.C. 154(b) by 0 days.

(21) Appl. No.: 14/228,400

(22) Filed: Mar. 28, 2014

(65) Prior Publication Data

US 2014/0291216 A1 Oct. 2, 2014

(30) Foreign Application Priority Data

Mar. 28, 2013 (FR) ..... 13 52817

(51) Int. Cl.
*B07B 1/28* (2006.01)
*B07B 1/46* (2006.01)

(52) U.S. Cl.
CPC ..... *B07B 1/28* (2013.01); *B07B 1/4627* (2013.01); *B07B 2201/02* (2013.01); *B07B 2201/04* (2013.01)

(58) Field of Classification Search
CPC ..... B07B 1/00; B07B 1/42
USPC ..... 209/365.2, 405, 363
See application file for complete search history.

(56) References Cited

U.S. PATENT DOCUMENTS

| | | | | |
|---|---|---|---|---|
| 5,199,574 | A * | 4/1993 | Hollyfield et al. | 209/315 |
| 5,341,939 | A * | 8/1994 | Aitchison et al. | 209/319 |
| 6,889,846 | B2 * | 5/2005 | Olsen et al. | 209/404 |
| 2014/0061102 | A1 * | 3/2014 | Sauser | 209/315 |
| 2014/0291216 | A1 * | 10/2014 | Brunone | 209/365.3 |
| 2015/0027932 | A1 * | 1/2015 | Andersen | 209/3 |

FOREIGN PATENT DOCUMENTS

| | | | |
|---|---|---|---|
| EP | 0 937 508 | A2 | 8/1999 |
| FR | 912 940 | A | 8/1946 |
| FR | 2 721 236 | A1 | 12/1995 |
| WO | 9219392 | A1 | 11/1992 |

OTHER PUBLICATIONS

FR 13 52817, INPI, Rapport de Recherche Préliminaire, Feb. 12, 2014.

* cited by examiner

*Primary Examiner* — Terrell Matthews
(74) *Attorney, Agent, or Firm* — Soquel Group LLC

(57) ABSTRACT

A screen including a plurality of decks vertically stacked above one another, at least one of the decks bearing at least one sieve, the screen including means for vertically separating the decks from one another, suitable for selectively adjusting a vertical distance between each deck of the plurality of decks and at least one other deck of the plurality of decks.

16 Claims, 6 Drawing Sheets

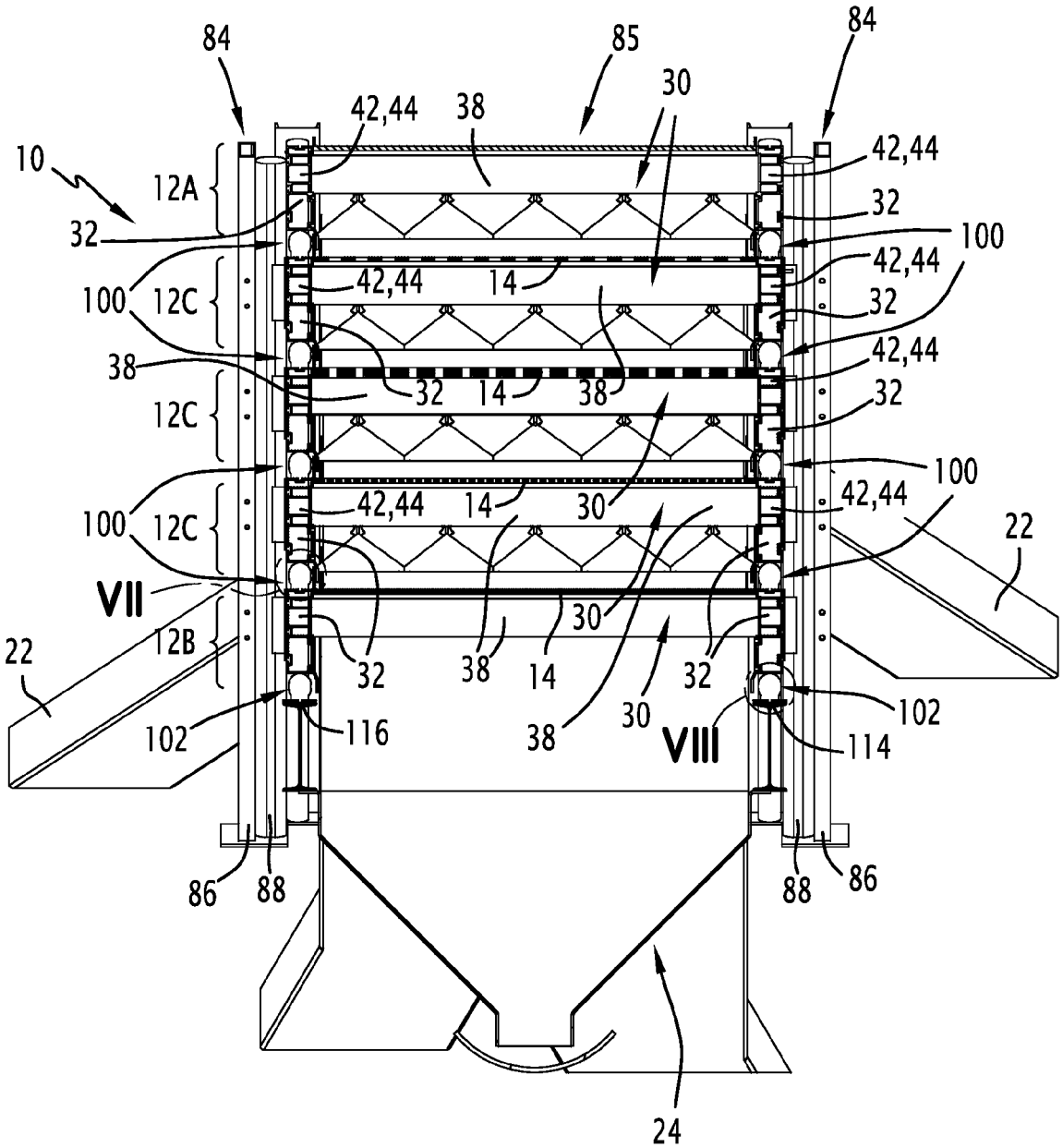
FIG.2
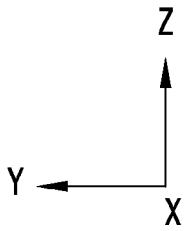

SCREEN COMPRISING A PLURALITY OF STACKED DECKS AND MEANS FOR VERTICALLY SEPARATING THE DECKS FROM ONE ANOTHER

CROSS-REFERENCE TO RELATED APPLICATION

This application claims priority to French Patent Application No. 13 52817, filed by inventor René Brunone on Mar. 28, 2013.

FIELD OF THE INVENTION

The present invention relates to a screen for sorting pellets of a granular product by their respective particle sizes, of the type comprising a screen for sorting pellets of a granular product based on their respective particle sizes, comprising a plurality of decks vertically stacked above one another, at least one of the decks bearing at least one sieve.

BACKGROUND OF THE INVENTION

Screens are commonly used in the mining industry to separate the pellets of a mined granular product based on their respective particle sizes. To that end, each screen comprises a plurality of sieves having different meshes, and the product passes through the different sieves, from the sieve with the coarsest mesh to the sieve with the finest mesh. The largest pellets are then collected on the surface of the first sieve, and the finest are collected below the last sieve, for example using a hopper.

To favor the flow of the product between two successive sieves, the latter are generally stacked above one another.

To favor the passage of the pellets with the smallest particle sizes through the meshes of the sieves, each sieve is generally vibrated by an electrical vibrator, such as an unbalanced vibrator.

The existing screens are not, however, fully satisfactory. In fact, it is regularly necessary to operate on a sieve for maintenance of the screen. This operation is generally done by an operator, who to that end is required to enter the small vertical space separating two consecutive sieves. The operator must thus perform the maintenance while being confined in a narrow space where the air is most often saturated with fine particles. These operating conditions often cause work-related illnesses, in particular respiratory illnesses.

SUMMARY

One aim of the invention is to propose a screen with easier maintenance. Another aim is to propose a compact screen.

To that end, the invention relates to a screen of the aforementioned type, in which the screen comprises means for vertically separating the decks from one another, suitable for selectively adjusting a vertical distance between each deck of the plurality of decks and at least one other deck of the plurality of decks.

According to specific embodiments of the invention, the screen also has one or more of the following features, considered alone or according to any technically possible combination(s):

- the screen comprises a support frame for the decks, and the vertical separating means comprise means for vertically immobilizing at least one of the decks relative to the frame, as well as a plurality of inflatable support members each defining a support surface for one of the decks in the vertical direction;
- each inflatable support member is made up of an inflatable flange, elongated in a direction of flow of the product along each deck;
- the inflatable support members comprise at least one intermediate inflatable support member, inserted between two consecutive decks;
- the or each sieve is removable;
- the screen comprises means for securing the or each sieve to the deck supporting it by deforming part of a first element from among the sieve and the deck;
- the securing means comprise at least one male member, secured to the first element and having an inner chamber for receiving a pressurized gas to inflate said male member, at least one female member for receiving said male member, formed in the second element among the sieve and the deck, and a device for injecting a pressurized gas into the male member;
- the screen comprises a plurality of vibrators each attached to a respective deck of the plurality of decks to vibrate said deck and adapted to one another so as to vibrate at least one of the decks at a different frequency from the frequency of vibration of each other deck;
- the screen comprises at least one vibration absorbing member, inserted between two consecutive decks of the plurality of decks;
- the or each vibration absorbing member is made up of an intermediate inflatable support member;
- the screen comprises, for at least one of the vibrators, an element for easy fastening of said vibrator to its respective deck, said easy fastening element including a support for the vibrator, and a platen, secured to said support and received in a slot formed in the respective deck;
- the screen comprises a support frame for the decks, said frame comprising a plurality of vertical posts defining a space between them for receiving the decks, the decks being translatable in the vertical direction relative to the posts;
- each post has a bearing surface against at least one of the decks;
- each post comprises a vibration absorber, defining the bearing surface; and
- at least one of the decks comprises a rigid chassis, having an inner channel for the circulation of a fluid spraying the product, said deck further comprising at least one spray nozzle for spraying the fluid on the product, the or each nozzle being in fluid communication with said inner channel.

BRIEF DESCRIPTION OF THE DRAWINGS

Other features and advantages of the invention will appear upon reading the following description, provided solely as an example and done in reference to the appended drawings, in which:

FIG. 2 is a rear and transverse cross-sectional view of the screen of FIG. 1;

DETAILED DESCRIPTION

Hereinafter, the orientation terms must be understood in reference to an orthogonal reference shown in the Figures, and which distinguishes:

- a longitudinal axis X, horizontal, oriented from back to front,
- a transverse axis Y, horizontal, oriented from right to left, and
- a vertical axis Z, oriented from bottom to top.

Figure 1:
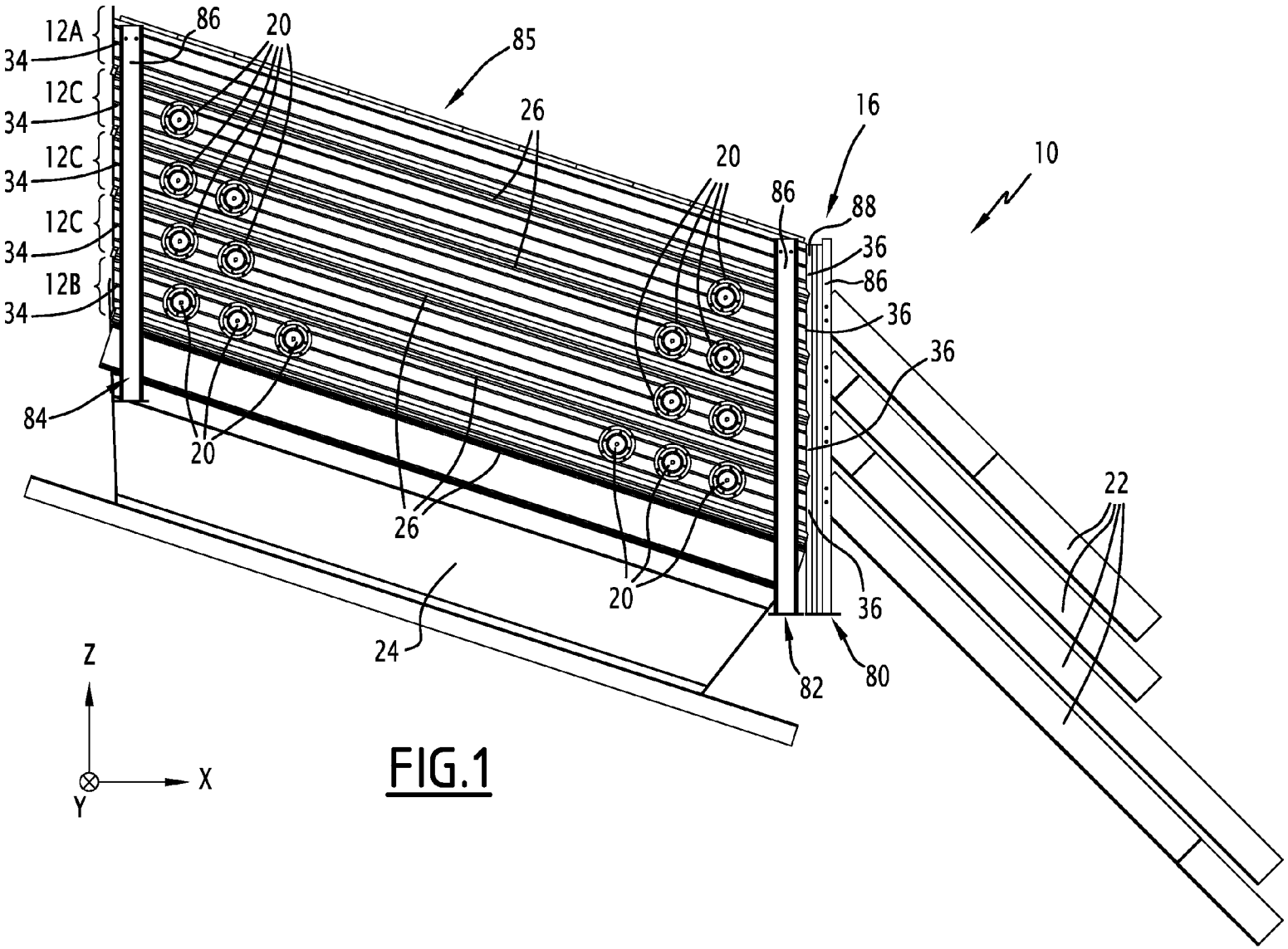
FIG. 1 is an elevation view of a screen according to the invention.

The screen 10, shown in FIG. 1, is designed to sort pellets of a granular product based on their respective particle sizes. To that end, the screen 10 comprises a plurality of decks 12A, 12B, 12C vertically stacked on top of one another, said decks 12A, 12B, 12C comprising an upper deck 12A at the apex of the stack, a lower deck 12B at the bottom of the stack, and a plurality of intermediate decks 12C between the lower 12B and upper 12A decks. The screen 10 further comprises a support frame 16 for the decks 12A, 12B, 12C, a plurality of vibrators 20 for vibrating the decks 12B, 12C, chutes 22 for recovering the granular product at the outlet of each deck 12B, 12C, and a hopper 24 for recovering the granular product below the lower deck 12C. Lastly, the screen 10 comprises members 26 for vertically separating the decks 12A, 12B, 12C relative to one another.

In reference to FIGS. 1 and 2, each deck 12A, 12B, 12C comprises a rigid chassis 30. This chassis 30 is made up of two beams 32 each extending from a rear end 34 to a front end 36 of the deck 12, and each defining a right edge and a left edge of the deck 12A, 12B, 12C, and a plurality of crosspieces 38 each connecting one beam 32 to the other. Each beam 32 and each crosspiece 30 is typically made up of an aluminum profile.

Each beam 32 is inclined relative to the horizontal from back to front. In other words, the rear end of each beam 32 is higher than its front end.

The crosspieces 38 are regularly distributed between the beams 32, such that each crosspiece 38 is equidistant from the crosspiece 38 positioned immediately in front and the crosspiece 38 positioned immediately behind.

Figure 3:
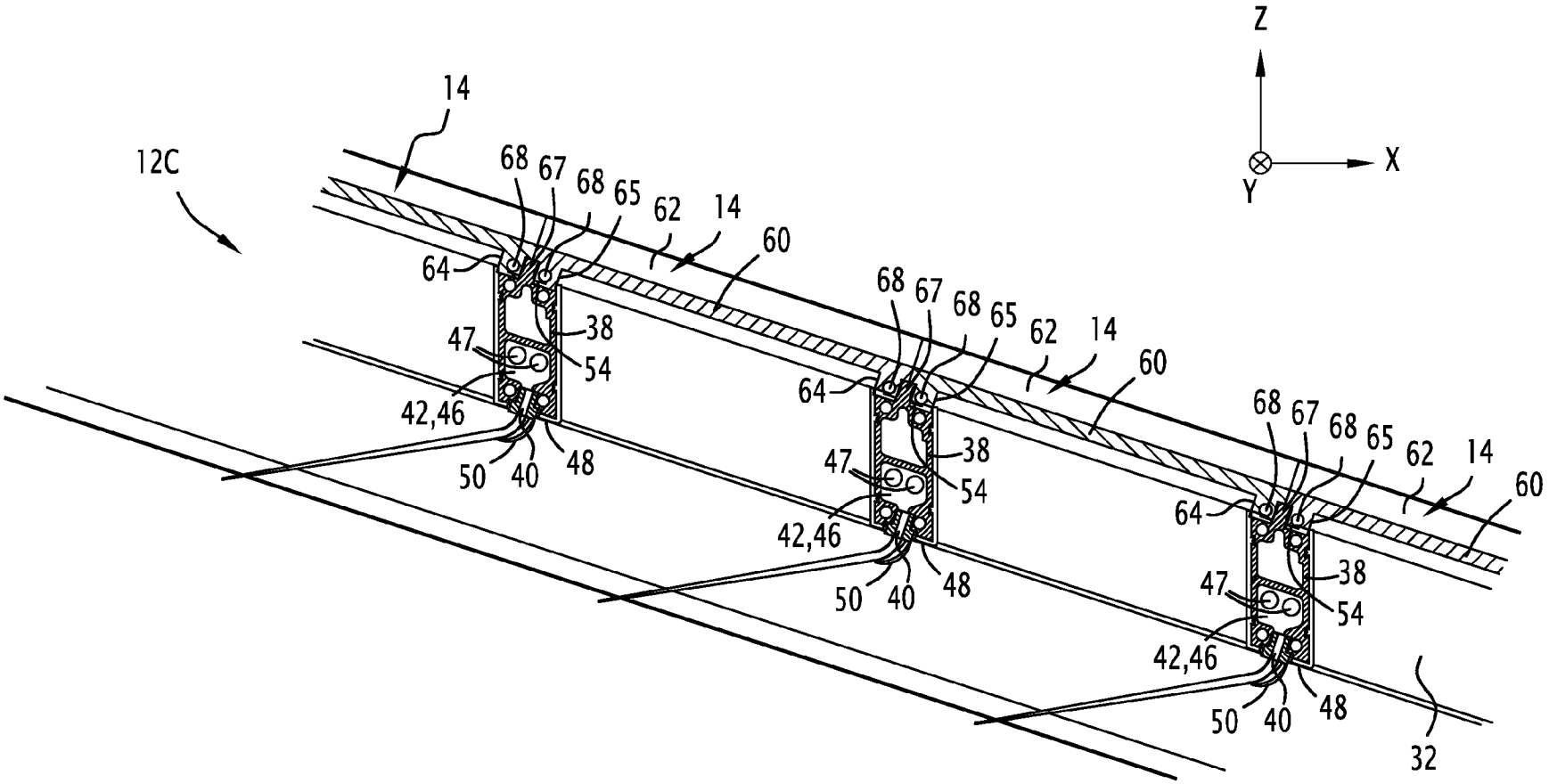
FIG. 3 is a longitudinal cross-sectional view of a deck of the screen of FIG. 1.

The upper deck 12A and each intermediate deck 12C further comprises a plurality of nozzles 40 for spraying the granular product, as shown in FIG. 3.

In reference to FIGS. 2 and 3, the chassis 30 of each of these decks 12A, 12C has an inner channel 42 for the circulation of a fluid for spraying the granular product, typically water. This channel 42 comprises two fluid inlet ducts 44, each formed in a respective beam 32, and a plurality of supply ducts 46 for supplying the nozzles 40 with fluid, each formed in a respective crosspiece 38. Each supply duct 46 is in fluid communication with at least one of the inlet ducts 44, owing to a plurality of orifices 47 formed in each beam 32. A static sealing gasket (not shown) is positioned at the interface between the supply duct 46 and said inlet duct 44.

Each spray nozzle 40 is formed in a crosspiece 38 of the chassis 30. It emerges in the supply duct 46 formed in the crosspiece 38, and in a lower outer face 48 of the crosspiece 38. Thus, it is suitable for projecting the spraying fluid onto the granular product flowing over the sieves 14 supported by the deck 12B, 12C situated below. It is preferably associated with a deflector 50 to disperse the sprayed fluid on the granular product. This deflector 50 is oriented toward the rear.

Figure 4:
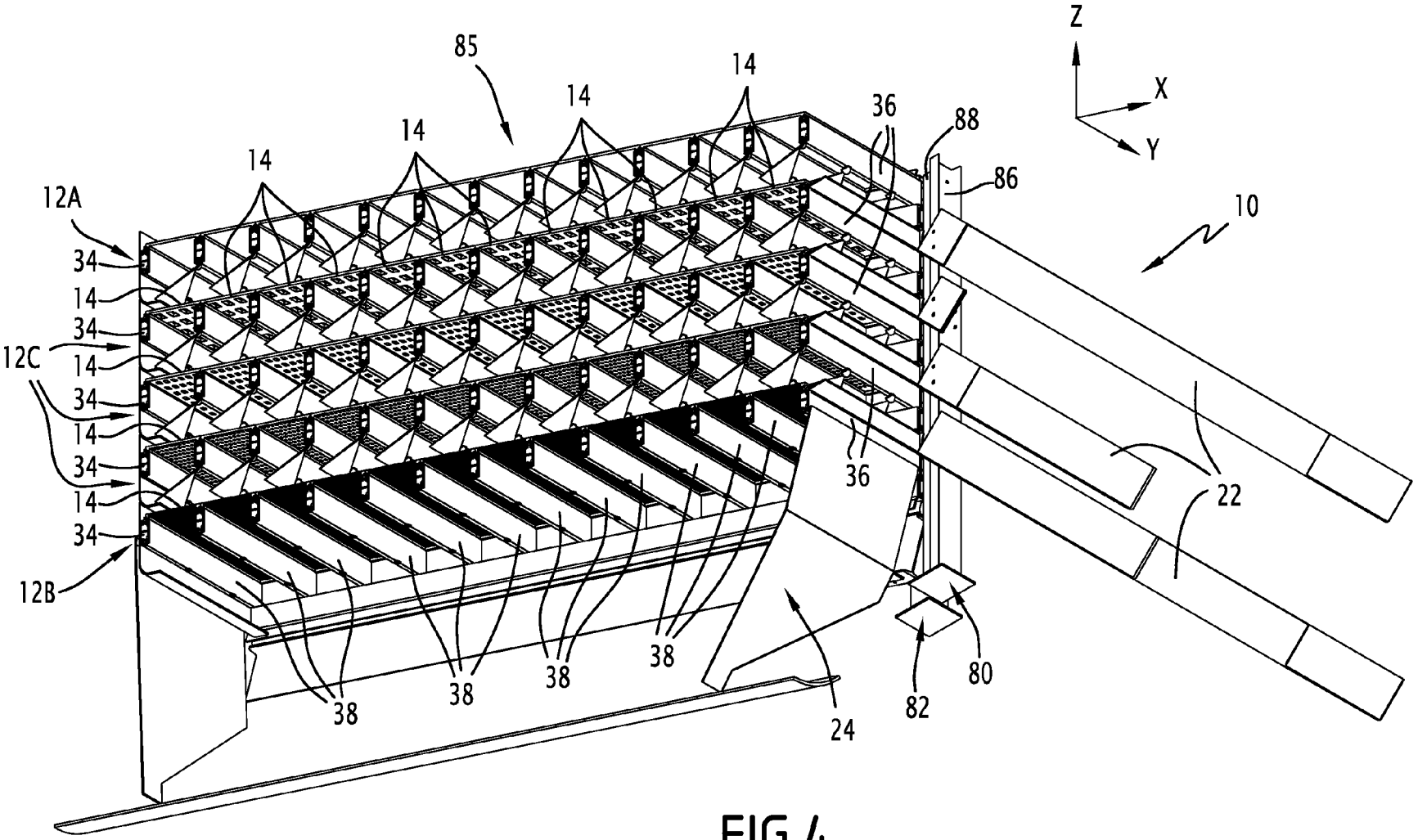
FIG. 4 is a perspective side and longitudinal cross-sectional view of the screen of FIG. 1.

In reference to FIG. 4, the lower deck 12B and each intermediate deck 12C supports a plurality of removable sieves 14.

The sieves 14 of each set of sieves 14 supported by a same duct 12B, 12C are alongside one another in the longitudinal direction of the deck 12B, 12C.

Figure 5:
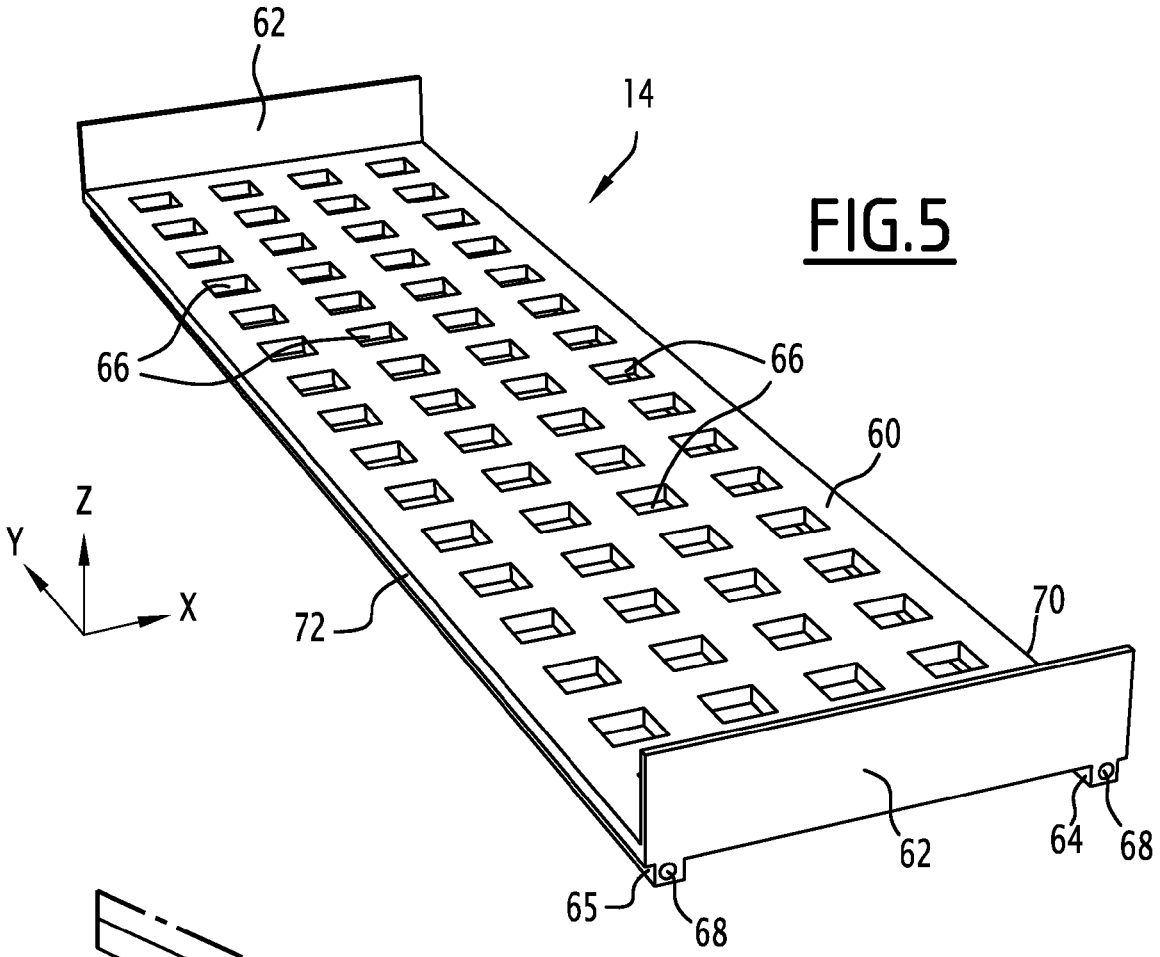
FIG. 5 is a perspective view of a detail of the screen of FIG. 1.

In reference to FIG. 5, each sieve 14 comprises a substantially flat open-worked bottom 60, two lateral borders 62 each protruding upward from a lateral end of the bottom 60, and two male members 64, 65 for fastening the sieve 14 to the deck 12B, 12C supporting it.

The bottom 60 is made from a plastic material, for example rigid or flexible polyurethane, or steel. It has a plurality of through orifices 66 each emerging in an upper face and a lower face of the bottom 60. Each through orifice 66 has a diameter substantially equal to the diameter of each other through orifice 66 of the sieve 14. The orifices 66 are regularly distributed on the bottom 60.

The diameter of these orifices 66 determines a so-called "mesh" of the sieve 14. This mesh is considered "fine" when the orifices 66 have a small diameter, and "coarse" when the orifices 66 have a large diameter.

Each sieve 14 has a mesh equal to the mesh of each other sieve 14 supported by the same deck 12B, 12C, and different from the mesh of each sieve 14 supported by each other deck 12B, 12C. In particular, each sieve 14 supported by a deck 12B, 12C has a finer mesh than that of each sieve 14 supported by each upper deck 12C, and a coarser mesh than that of each sieve 14 supported by each lower deck 12B, 12C.

Each sieve 14 is adapted so that, when it is fastened to the deck 12B, 12C supporting, its bottom 60 is inclined relative to the horizontal from back to front. Thus, the granular product, when placed on the sieve 14, will tend to flow toward the front of the sieve 14.

Each male member 64, 65 is designed to cooperate with a female member formed in the deck 12B, 12C supporting the sieve 14. This female member is, in the illustrated example, made up of a space formed between two transverse ribs 67 (FIG. 3) each supported by a crosspiece 38 specific to said deck 12B, 12C, each ribbon 52 protruding upward from an upper outer face 54 of said specific crosspiece 38.

Each male member 64, 65 is made up of a transverse rib protruding downward from the lower face of the bottom 60. Each male member 64, 65 has an inner chamber 68 for recovering a pressurized gas to inflate said male member 64, 65. Each male member 64, 65 is preferably made from a flexible plastic material, typically flexible polyurethane.

A first male member 64 extends along a front edge 70 of the bottom 60, and the other male member 65 extends along a rear edge 72 of the bottom 60. Each male member 64, 65 is preferably, as shown, offset toward the center of the bottom 60 relative to said edge 70, 72.

In particular, the male members 64, 65 are positioned such that, when the sieve 14 is mounted on the deck 12B, 12C supporting it, the front male member 64 is flush with a rear face of a rim 67 of the corresponding female member, while the rear male member 65 is flush with the front face of the other rib 67 of said female member, as shown in FIG. 3. Thus, when each male member 64, 65 is inflated, each male member 64, 65 bears strongly against one of the ribs 67, and the friction forces prevent the sieve 14 from being removed from the deck 12B, 12C supporting it.

Returning to FIG. 1, the frame 16 comprises six posts 80, 82, 84, only three of which are visible in FIG. 1. These posts 80, 82, 84 define a space 85 between them for receiving the decks 12A, 12B, 12C, in which the stack of decks 12A, 12B, 12C and the hopper 24 are positioned.

Each post 80, 82, 84 is elongated in the vertical direction Z. It comprises a rigid support member 86 and a flexible vibration absorber 88.

The support member 86 extends over the entire length of the post 80, 82, 84. It is typically made up of a metal profile.

The vibration absorber 88 is inserted between each support member 86 and the decks 12A, 12B, 12C. It defines a bearing surface against each deck 12. In the illustrated example, it is made up of an inflatable flange, typically made from polyurethane.

A first pair of posts 80 is positioned in front of the stack of decks 12A, 12B, 12C. Said posts 80 are aligned transversely with one another, a transverse space being left free between said posts 80 to discharge the granular product outside the decks 12A, 12B, 12C. Each of said posts 80 bears against a front end of one of the beams 32 of each deck 12A, 12B, 12C.

A second pair of posts 82 transversely frames a front end of the decks 12A, 12B, 12C. A first of the posts 82 of that pair, visible in FIG. 1, bears against a front end segment of the right beam 32 of each deck 12A, 12B, 12C, and the other post 82 bears against a front end segment of the left beam 32 of each deck 12A, 12B, 12C.

A third pair of posts 84 transversely frames a rear end of the decks 12A, 12B, 12C. A first of the posts 84 in that pair, visible in FIG. 1, bears against a rear end segment of the right beam 32 of each deck 12A, 12B, 12C, and the other post 84 bears against a rear end segment of the left beam 32 of each deck 12A, 12B, 12C.

Figure 6:
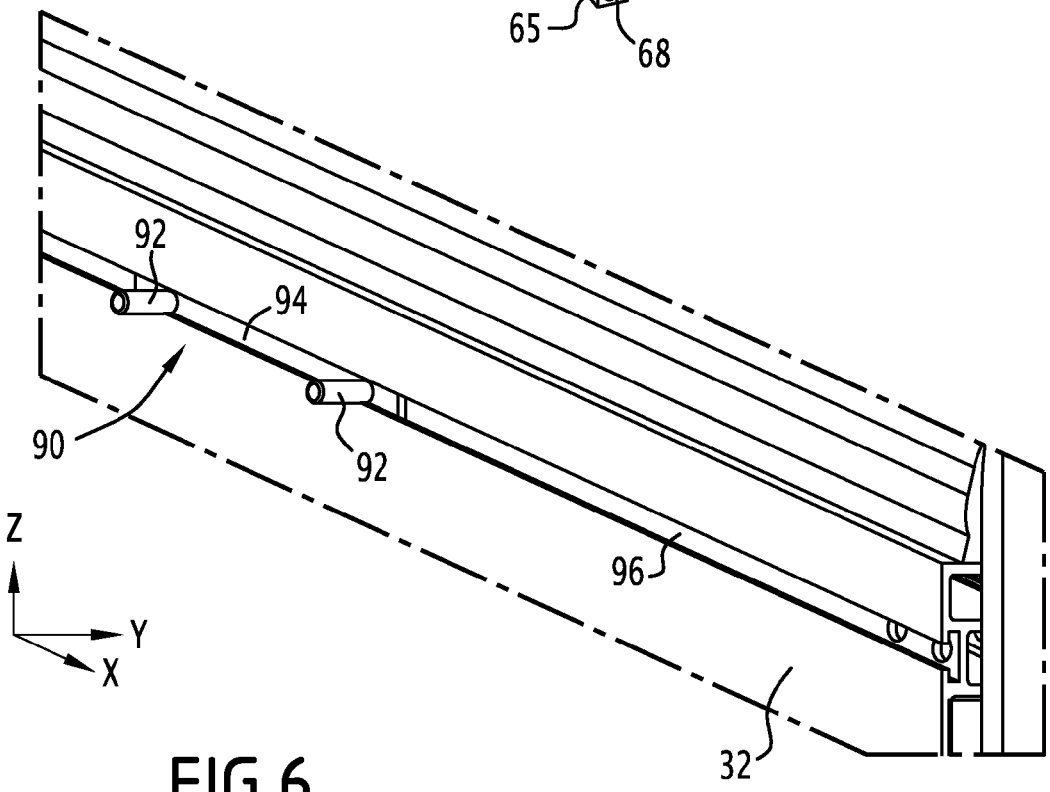
FIG. 6 is a perspective view of a detail of the screen of FIG. 1.

Each vibrator 20 is attached to a respective deck 12B, 12C by means of an easy fastening element 90, shown in FIG. 6. As shown in that Figure, the fastening element 90 comprises a support 92 for the vibrator 20, and the platen 94 secured to the support 92. In the illustrated example, the fastening element 90 comprises a second support 92 for another vibrator 20.

The platen 94 is oriented substantially vertically. It is engaged in a longitudinal slot 96 formed in one of the beams 32 of the respective deck 12B, 12C.

Each support 92 is made up of a lug protruding transversely opposite the deck 12B, 12C from the platen 94.

The vibrator 20 is mounted on one of the supports 92. The beam 32 is pinched between the vibrator 20 and the platen 94, so as to block the translation of the fastening element 90.

Returning to FIG. 1, the vibrators 20 are adapted to one another such that the decks 12B, 12C do not vibrate at the same frequency. The vibration frequency of each deck 12B, 12C can thus be adjusted such that it is adapted to the size of the particles that the sieves 14 supported by the deck 12B, 12C are supposed to separate from the rest of the granular product. In particular, the vibrators 20 are adapted so that the vibration frequency of the decks 12B, 12C increases with the fineness of the mesh of the sieves 14 supported by each deck 12B, 12C.

To that end, in the illustrated example, only four vibrators 20 are fastened to the first intermediate deck 12C, eight vibrators 20 are fastened to each of the next two intermediate decks 12C, and twelve vibrators 20 are fastened to the lower deck 12B.

The separating members 26 are suitable for selectively adjusting the vertical distance between each deck 12B, 12C and each of the decks 12A, 12C positioned above said deck 12B, 12C. In particular, the separating members 26 are suitable for increasing the vertical distance relative to a reference vertical distance between said decks 12A, 12B, 12C, i.e., to lower each deck 12B, 12C relative to the decks 12A, 12C positioned above.

To that end, the separating members 26 comprise, in reference to FIG. 2, members (not shown) for vertically immobilizing each deck 12A, 12C relative to the frame 16, and inflatable members 100, 102 for supporting the decks 12A, 12B, 12C.

The vertical immobilization members for example comprise a plurality of pins (not shown), typically made from steel, a plurality of first holes (not shown) for the passage of said pins, formed in the posts 82 and 84 of the frame 16, and a plurality of second holes (not shown) for receiving said pins, formed in the chasses 30 of the decks 12A, 12C, each first hole being positioned so as to be in line with a second hole formed in one of the decks 12A, 12C when said deck 12A, 12C is in a reference position. Aside from these vertical immobilizing members, the screen 10 does not comprise other means for securing the decks 12A, 12B, 12C to the frame 16, such that the decks 12A, 12B, 12C are normally freely translating in the vertical direction Z relative to the posts 80, 82, 84.

Each inflatable member 100, 102 defines a support surface for one of the decks 12A, 12B, 12C in the vertical direction Z. Each post 32 of each deck 12A, 12B, 12C rests on one of said inflatable members 100, 102.

Each inflatable member 100, 102 also constitutes a member for absorbing vibrations of the decks 12B, 12C.

Each inflatable member 100, 102 is in particular formed by an inflatable flange elongated in the longitudinal direction. Thus, the flexibility of each inflatable member 100, 102 in the transverse direction Y is limited, such that parasitic vibrations are avoided.

The inflatable members 100, 102 comprise a plurality of intermediate inflatable support members 100, each inserted between two consecutive decks 12A, 12B, 12C while being in contact with said two decks 12A, 12B, 12C. In particular, for each pair of consecutive decks 12A, 12B, 12C, two intermediate inflatable members 100 are inserted between said decks 12A, 12B, 12C: one between the right beams 32 of said decks 12A, 12B, 12C, and the other between the left beams 32 of said decks 12A, 12B, 12C.

Figure 7:
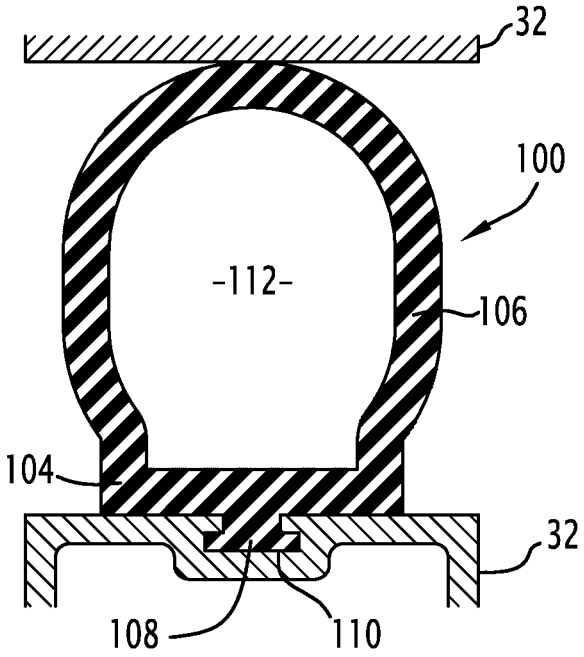
FIG. 7 is a view of a detail marked VII in FIG. 2.

In reference to FIG. 7, each intermediate inflatable member 100 comprises a base 104 secured to a beam 32 of the deck 12A, 12B, 12C below, and an extendable part 106, integral with the base 104 and defining a support surface for a beam 32 of the deck 12A, 12B, 12C above.

The base 104 comprises a T-shaped rib 108, protruding downward from a lower face of the base 104, for securing the intermediate inflatable member 100 to the beam 32 of the deck 12A, 12B, 12C below. This T-shaped rib 108 cooperates with a slot 110 formed in said beam 32.

The extendable part 106 defines a chamber 112 with the base 104 for receiving a pressurized fluid for the expansion of the extendable part 106.

Returning to FIG. 2, the inflatable members 100, 102 also comprise two lower inflatable support members 102, each inserted between the hopper 24 and the lower deck 12B. In particular, one of said lower inflatable members 102 is inserted between a right rim 114 of the hopper 24 and the right beams 32 of the deck 12B, and the other lower inflatable member 102 is inserted between a left rim 116 of the hopper 24 and the left beams 32 of the deck 12B.

Figure 8:
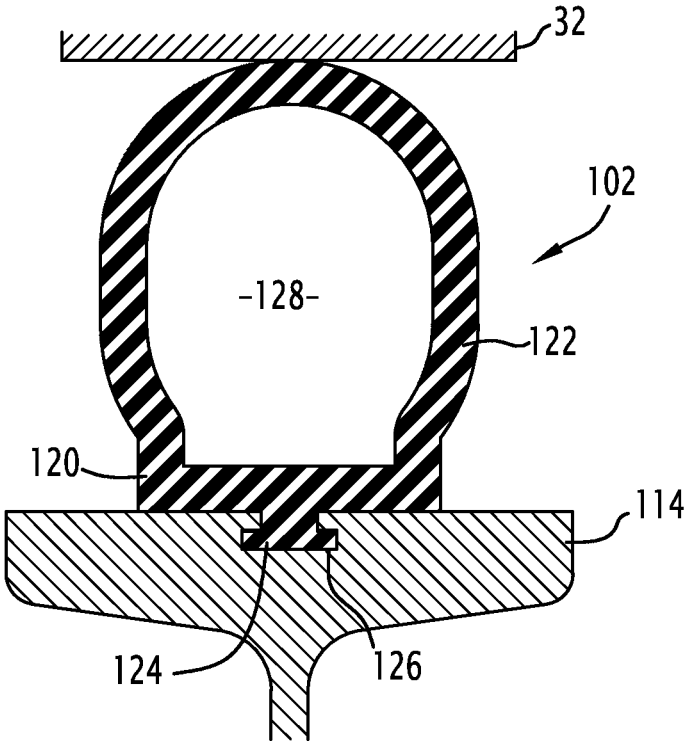
FIG. 8 is a view of a detail marked VIII in FIG. 2.

In reference to FIG. 8, each lower inflatable member 102 comprises a base 120 secured to the right 114 or left 116 rim of the hopper 24, and an extendable part 122, integral with the face 120 and defining a support surface of a beam 32 of the deck 12.

The base 120 comprises a T-shaped rib 124, protruding downward from a lower face of the base 120, to secure the lower inflatable member 102 to the right 114 or left 116 rim of the hopper 24. This T-shaped rib 124 cooperates with a slot 126 formed in said rim 114, 116.

The extendable part 122 defines, with the base 120, a chamber 128 for receiving a pressurized fluid for the expansion of the extendable part 122.

A maintenance method for the screen 10 will now be described, in reference to FIGS. 1 to 6.

First, the screen 10 is stopped. To that end, the operator commands the stop of the supply of the screen 10 with granular product, waits for all of the product to be evacuated from the screen 10, then cuts the power for the spray fluid from the nozzles 40, and stops the vibrators 20.

Then, the operator moves the deck 12A, 12C positioned immediately above the deck 12B, 12C on which he wishes to perform the maintenance operation. To that end, the operator first blocks the deck 12A, 12C positioned immediately above so that it cannot lower relative to the frame 16, while engaging each pin in a second hole formed in said deck 12A, 12C, as well as in the first hole positioned in line with said second hole. Next, the operator deflates all of the inflatable support members 100, 102 positioned below the deck 12B, 12C on which he wishes to perform the maintenance operation. In so doing, the deck 12B, 12C is lowered relative to the frame 16, and thus moves away from the deck 12A, 12C positioned immediately above.

In the following step, the operator deflates the inflatable support members 100 secured to the deck 12B, 12C on which he is operating. The operator then has access to the sieves 14 supported by the deck 12B, 12C.

The operator next separates the sieves 14 from the deck 12B, 12C. To that end, he deflates the male members 64, 65 of each sieve 14.

Then, he removes each sieve 14 from the deck 12B, 12C, cleans it away from the screen 10, and then replaces it on the deck 12B, 12C.

Once each sieve 14 is replaced, the operator re-inflates the male members 64, 65, for example using an air compressor connected to the inner chamber 68 of each male member 64, 65.

The operator next re-inflates each inflatable support member 100, 102 previously deflated, still using the air compressor.

Lastly, the operator unblocks the deck 12A, 12C situated immediately above the deck 12B, 12C on which he has operated. He can then return the screen 10 to operation, or perform the maintenance of another deck 12B, 12C.

Owing to the invention described above, the maintenance of the screen 10 is made easier, and the risks of work-related illness are reduced, the maintenance operator no longer having to operate in a confined space.

Furthermore, the screen 10 is compact, since all of the sorting levels are stacked on top of one another. It is not necessary to place different cascading screens in light of the excellent sorting quality procured by the screen 10, in particular due to the different vibration frequencies from one deck 12B, 12C to the next. Additionally, integrating the channels 42 into the chassis 30 of the decks 12A, 12C avoids the addition of a bulky specific device for spraying the granular product.

The invention claimed is:

1. A screen for sorting pellets of a granular product by their respective particle sizes, comprising:

a plurality of decks vertically stacked above one another, at least one of the decks bearing at least one sieve;

a support frame for said decks; and a spacer for vertically spacing said decks out from one another, suitable for selectively adjusting a vertical distance between each deck of said plurality of decks and at least one other deck of said plurality of decks, comprising:

an immobilizer for vertically immobilizing at least at least one of said decks relative to said support frame; and a plurality of inflatable support members, each defining a support surface for one of said decks in the vertical direction.

2. The screen according to claim 1, wherein each inflatable support member comprises an inflatable flange, elongated in a direction of flow of the product along each deck.

3. The screen according to claim 1, wherein the inflatable support members comprise at least one intermediate inflatable support member, inserted between two consecutive decks while being in contact with two decks.

4. The screen according to claim 1, wherein the at least one sieve is removable.

5. The screen according to claim 4, comprising a fastener for securing the at least one sieve to the deck supporting it by deforming part of a first element from among the sieve and the deck.

6. The screen according to claim 5, wherein said fastener comprise at least one male member, secured to the first element and having an inner chamber for receiving a pressurized gas to inflate said male member, at least one female member for receiving said male member, formed in a second element among the at least one sieve and the deck, and a device for injecting a pressurized gas into said male member.

7. The screen according to claim 3, comprising a plurality of vibrators, each attached to a respective deck of said plurality of decks to vibrate the deck and adapted to one another so as to vibrate at least one of the decks at a different frequency from the frequency of vibration of each other deck.

8. The screen according to claim 7, comprising at least one vibration absorbing member, inserted between two consecutive decks of the plurality of decks.

9. The screen according to claim 8, wherein the or each vibration absorbing member comprises an intermediate inflatable support member.

10. The screen according to claim 7, comprising, for at least one of said vibrators, an element for easy fastening of the vibrator to its respective deck, said element comprising a support for the vibrator, and a platen, secured to said support and received in a slot formed in the respective deck.

11. The screen according to claim 1, wherein said support frame comprise a plurality of vertical posts defining a space between them for receiving said decks, said decks being translatable in the vertical direction relative to said vertical posts.

12. The screen according to claim 11, wherein each vertical post has a bearing surface against at least one of said decks.

13. The screen according to claim 12, wherein each vertical post comprises a vibration absorber, defining the bearing surface.

14. The screen according to claim 1, wherein at least one of said decks comprises a rigid chassis, having an inner channel for the circulation of a fluid spraying the product, the deck further comprising at least one spray nozzle for spraying the fluid on the product, the or each nozzle being in fluid communication with said inner channel.

15. A screen for sorting pellets of a granular product by their respective particle size, comprising:

a plurality of decks vertically stacked above one another, at least one of the decks bearing at least one sieve;

a support frame for said decks comprising a plurality of vertical posts defining a space between them for receiving said decks, each vertical post having a bearing surface against at least one of said decks, each vertical post comprising a vibration absorber, defining the bearing surface, and said decks being translatable in the vertical direction relative to said vertical posts; and a spacer for vertically spacing said decks out from one another, suitable for selectively adjusting a vertical distance between each deck of said plurality of decks and at least one other deck of said plurality of decks.

16. A screen for sorting pellets of a granular product by their respective particle sizes, comprising:

a plurality of decks vertically stacked above one another, at least one of the decks bearing at least one sieve, at least one of said decks comprising a rigid chassis, having an inner channel for the circulation of a fluid spraying the product, the deck further comprising at least one spray nozzle for spraying the fluid on the product, the or each nozzle being in fluid communication with said inner channel; and a spacer for vertically spacing the decks out from one another, suitable for selectively adjusting a vertical distance between each deck of the plurality of decks and at least one other deck of the plurality of decks.

* * * * *